United States Patent [19]

James

[11] Patent Number: 4,907,499

[45] Date of Patent: Mar. 13, 1990

[54] ROOF RIDGE VENTILATORS AND METHODS FOR INSTALLING SUCH VENTILATORS

[76] Inventor: Gatacre A. F. James, 1104 El Prado, San Clemente, Calif. 92672

[21] Appl. No.: 337,055

[22] Filed: Apr. 12, 1989

[51] Int. Cl.[4] ..... F24F 7/02

[52] U.S. Cl. ..... 98/42.21; 52/57; 52/199

[58] Field of Search ..... 52/43, 47, 55, 57, 199; 98/42.21

[56] References Cited

U.S. PATENT DOCUMENTS

| | | | |
|---|---|---|---|
| 3,625,134 | 12/1971 | Smith | 98/42.21 |
| 3,862,529 | 1/1975 | Markos | 52/199 |
| 3,913,294 | 10/1975 | Freiborg | 52/518 |
| 3,949,657 | 4/1976 | Sells | 98/42.21 |
| 4,280,399 | 7/1981 | Cunning | 98/42.21 |
| 4,325,290 | 4/1982 | Wolfert | 98/42.21 |
| 4,558,637 | 12/1985 | Mason | 98/42.21 |
| 4,577,442 | 3/1986 | Callaway | 52/57 |
| 4,643,080 | 2/1987 | Trostle et al. | 98/42.21 |
| 4,676,147 | 6/1987 | Mankowski | 98/42.21 |
| 4,685,265 | 8/1987 | Cooper | 52/277 |
| 4,782,743 | 11/1988 | Quinnell | 98/42.21 |

FOREIGN PATENT DOCUMENTS 3543610 6/1987 Fed. Rep. of Germany ..... 52/57

*Primary Examiner*—Harold Joyce

*Attorney, Agent, or Firm*—Bright & Lorig

[57] ABSTRACT

Roof ridge ventilators include two panels joined by bendable hinges with each of the panels having an upper and lower surface. The lower surfaces of these panels include a plurality of spaced-apart, downwardly-projecting supports joined to the lower surfaces at substantially right angles and extending transversely across them. The support means on each panel have differing heights, with the first of the supports, of greatest height, being positioned near one end of the bottom surfaces, and with each successive support, behind the first, having successively smaller height than the preceding support. Each of the lower surfaces has substantially the same number of supports with substantially the same sizes and spacing to permit bending the ventilator over and attaching the ventilator to a roof ridge. The ventilator also includes air passages, such as a plurality of openings, of sufficient size and shape to facilitate overlapping these passages with a portion of the bottom surface of another of the ventilators. The ventilators are installed on a roof ridge by placing a cap shingle over the upper surface of the ventilator with the air passages left substantially uncovered by the shingle to form a first ventilator/shingle combination.

20 Claims, 9 Drawing Sheets

ROOF RIDGE VENTILATORS AND METHODS FOR INSTALLING SUCH VENTILATORS

This invention relates to roof ridge ventilators, and preferably to one-piece, unitary ventilators made of a thermoplastic such as polypropylene or polyethylene. These ventilators include two panels joined by bendable, preferably integrally-formed, preferably horizontally oriented, hinge means.

Each of these two panels has an upper and lower surface. Each of the lower surfaces of these panels includes a plurality of spaced-apart, downwardly-projecting support means, preferably in the form of fins or flanges, joined to these lower surfaces at substantially right angles. Preferably, the support means extend transversely, preferably substantially completely, across the widths of the lower surfaces. On each of the panels is a plurality of support means of differing heights, with the first of the support means, namely the support means of greatest height, being near one end of the bottom surfaces. Each successive support means behind the first support means is successively smaller in height than the preceding support means. Preferably, each of the lower surfaces of the panels has substantially the same number of support means, in substantially the same sizes, and with substantially the same spacing between the support means. More preferably, individual support means on one panel are in substantially the same plane as corresponding, individual support means on the other panel, and with sufficient spacing between the corresponding support means on these two panels to permit bending of the ventilator along the hinge means. The spacing between the support means on each panel is preferably sufficient to permit air to flow freely between and among them.

Alternatively, the support means may extend obliquely or longitudinally, or both, preferably substantially completely, across the lengths, widths, or both of the lower surfaces of the panels. In any of these alternative embodiments, each of the panels can include a plurality of support means of differing heights, with the first of the support means, namely the support means of greatest height, being near one end of the bottom surfaces, or near one lateral edge of the bottom surfaces.

In those embodiments where the support means are oriented longitudinally, at least in part, the support means nearest the lateral edges of the panels is preferably of greatest height. Each support means positioned laterally inwardly from the first support means is preferably of successively smaller height such that the support means nearest the hinge means is smallest in height. Further, each of these support means is of greatest height at the front end of each panel, and is of gradually diminishing height along its length. Alternatively, the support means nearest the hinge may be of greatest height, and each successive support means, namely each support means spaced laterally outwardly from this first support means, is successively smaller in height than the preceding support means. Again, each support means is, preferably, of gradually diminishing height from one end to the other along its length.

Each of the two panels in these ventilators includes, near the end opposite the end that includes the support means of greatest height, air passage means having a size and shape sufficient to permit overlapping such air passage means with a portion of the bottom surface of another of these ventilators. These air passage means, in preferred embodiments, lie, in part, on each of the two panels, and extend across the bendable hinge means linking the two panels. Preferably, these air passage means include a plurality of openings of the same or different shape. Preferably, these openings are round, and substantially the same in size and shape. Preferably, these openings have upwardly-projecting ridges around each of the openings to prevent water or debris from flowing readily into them.

On their upper surfaces, these ventilators include at least one, and preferably two, upwardly-projecting flange means, preferably positioned in front of the air passage means. These upwardly-projecting flange means are adapted to engage one or more of the downwardly-projecting support means to position properly one ventilator over another when the ventilators are installed over a roof ridge. The upwardly-projecting flange means and one of the downwardly-projecting support means, when engaged with one another, form means for blocking the flow of liquid and debris between two overlapping ventilators.

This invention also relates to methods for installing the new ventilators. These methods comprise placing a cap shingle over the upper surface of a first ventilator with the air passage means left substantially uncovered by the cap shingle, thus forming a first ventilator/shingle combination. The first ventilator/shingle combination is then bent along the hinge means of the ventilator, and the combination is placed over a roof ridge with the downwardly-projecting support means over, and preferably engaging the roof ridge.

Thereafter, a second ventilator/shingle combination is formed in the same way, and placed over the first ventilator/shingle combination (and over the roof ridge), with a portion of the second combination overlapping at least the air passage means in the first ventilator/shingle combination. Third and successive combinations are then formed, and placed in successive, overlapping relation to one another, over and after the second combination, with each combination overlapping the next preceding combination at least sufficiently to cover the air passage means of that next preceding combination. Each of the ventilator/shingle combinations is attached to the roof ridge, preferably by driving fasteners such as nails through the ventilator/shingle combination, near the front end of the combination.

BRIEF DESCRIPTION OF THE DRAWINGS

These ventilators and the methods of installing them can better be understood by reference to the enclosed drawings, in which:

FIG. 7 provides a top perspective view, and FIG. 8 a side perspective view of preferred embodiment 1 of the new ventilators. Ventilator 1 includes a pair of panels 9 and 10 of substantially the same size and shape joined to one another along vertically-oriented hinge 8.

Ventilator 1 is of one-piece construction and preferably molded from polypropylene, polyethylene or, other suitable plastic material with a living, horizontally-oriented hinge 8 formed by making the plastic thinner at the hinge then on panels 9 and 10.

Figure 1:
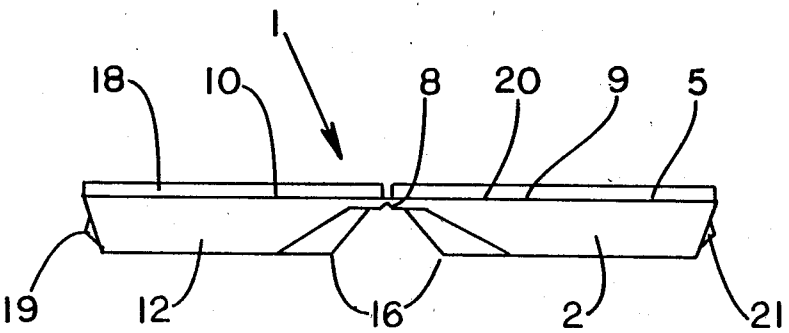
FIG. 1 shows a front end elevational view of a preferred embodiment of the new ventilators.
Figure 2:
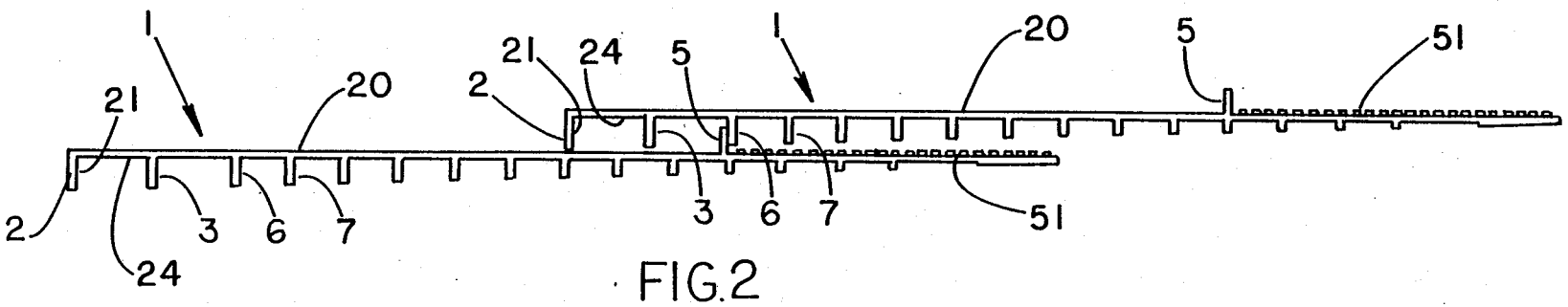
FIG. 2 shows a side elevational view of two ventilators of the preferred embodiment shown in FIG. 1, with a portion of the second ventilator overlapping a portion of the first ventilator.

FIG. 1 shows that ribs 2 and 12 have locator bumps 21 and 19 on their lateral edges, respectively. These locator bumps permit the user to identify the downwardly-projecting rib intended to engage flanges 5 and 18 for proper placement of one ventilator over another on a roof ridge.

On upper surface 20 of ventilator 1 are upwardly-projecting flanges 5 and 18. Flange 5 projects upwardly from panel 9; flange 18 projects upwardly from panel 10. Each of flanges 5 and 18 extends substantially completely across the width of panels 9 and 10, respectively. Space or gap 22 between panels 5 and 18 facilitates bending ventilator 1 along hinge 8.

Figure 3:
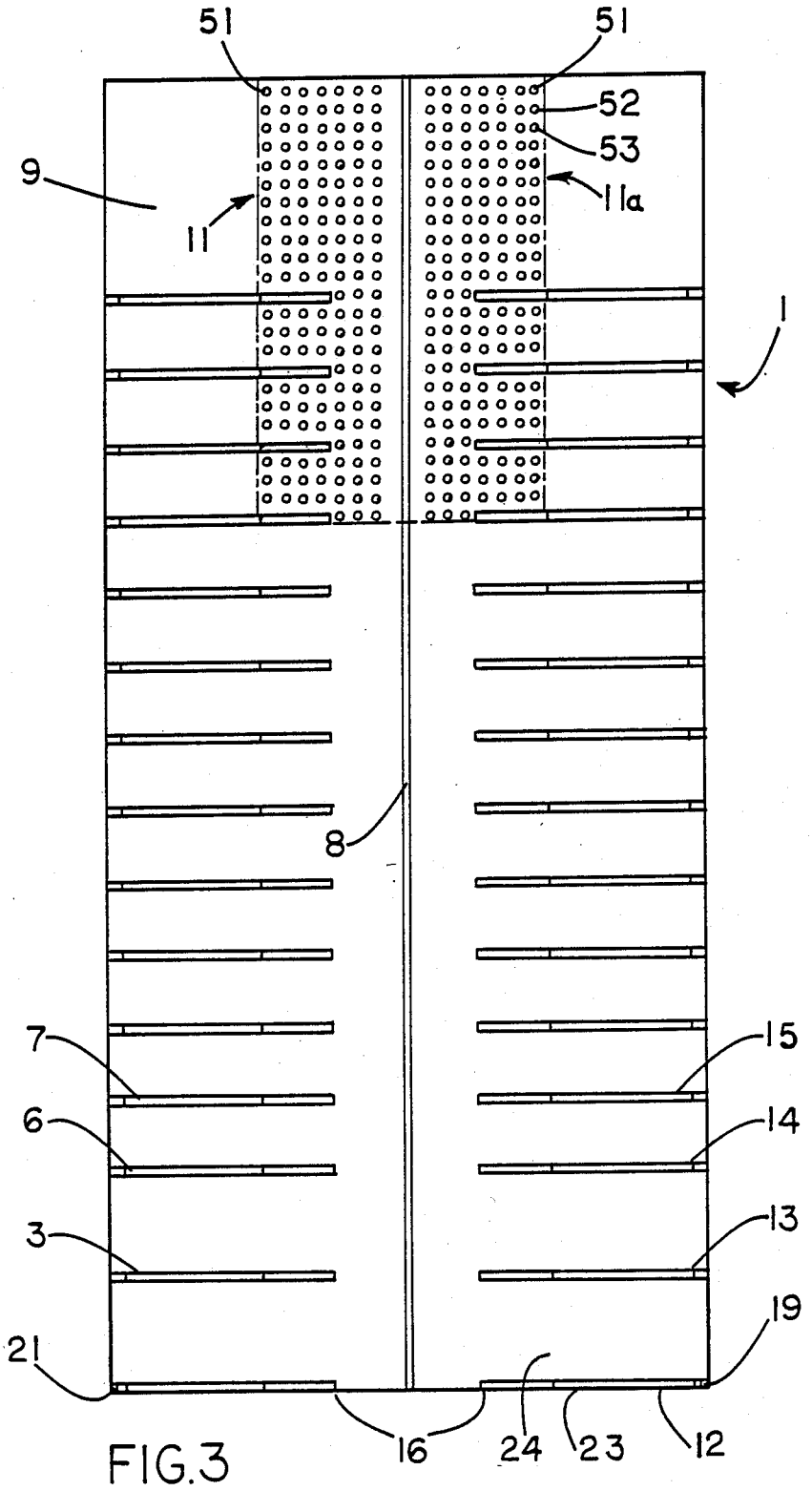
FIG. 3 shows a bottom plan view of the ventilator embodiment shown in FIG. 1.
Figure 4:
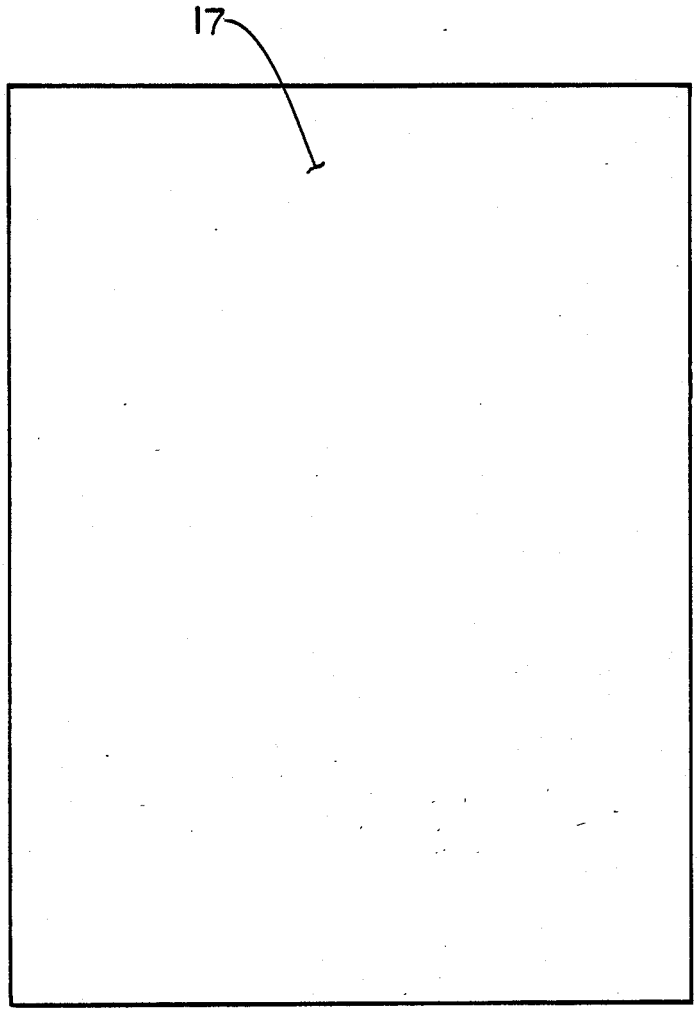
FIG. 4 shows a cap shingle for use with the ventilator embodiment shown in FIGS. 1–3.
Figure 5:
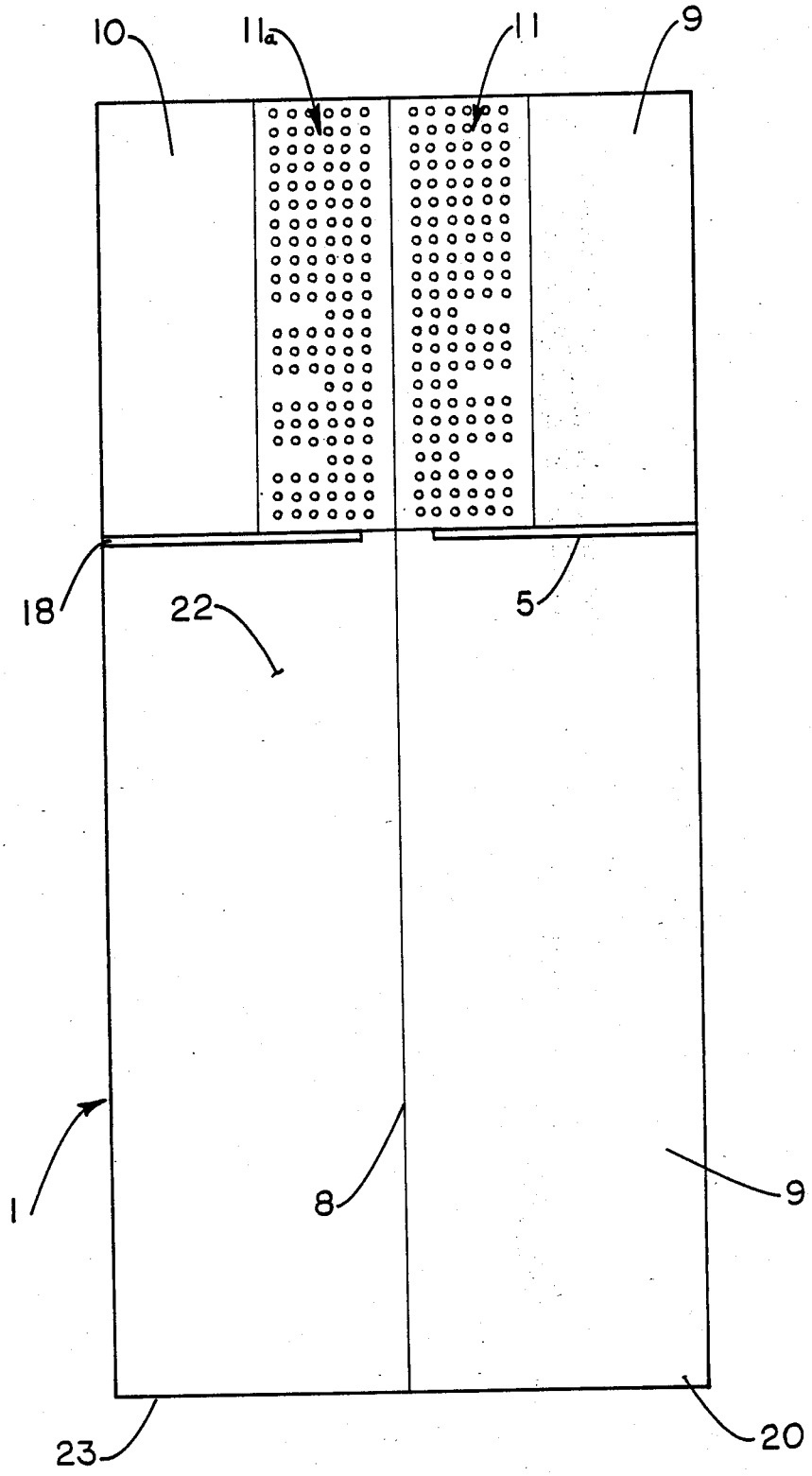
FIG. 5 shows a top plan view of the ventilator embodiment shown in FIGS. 1–3.
Figure 6:
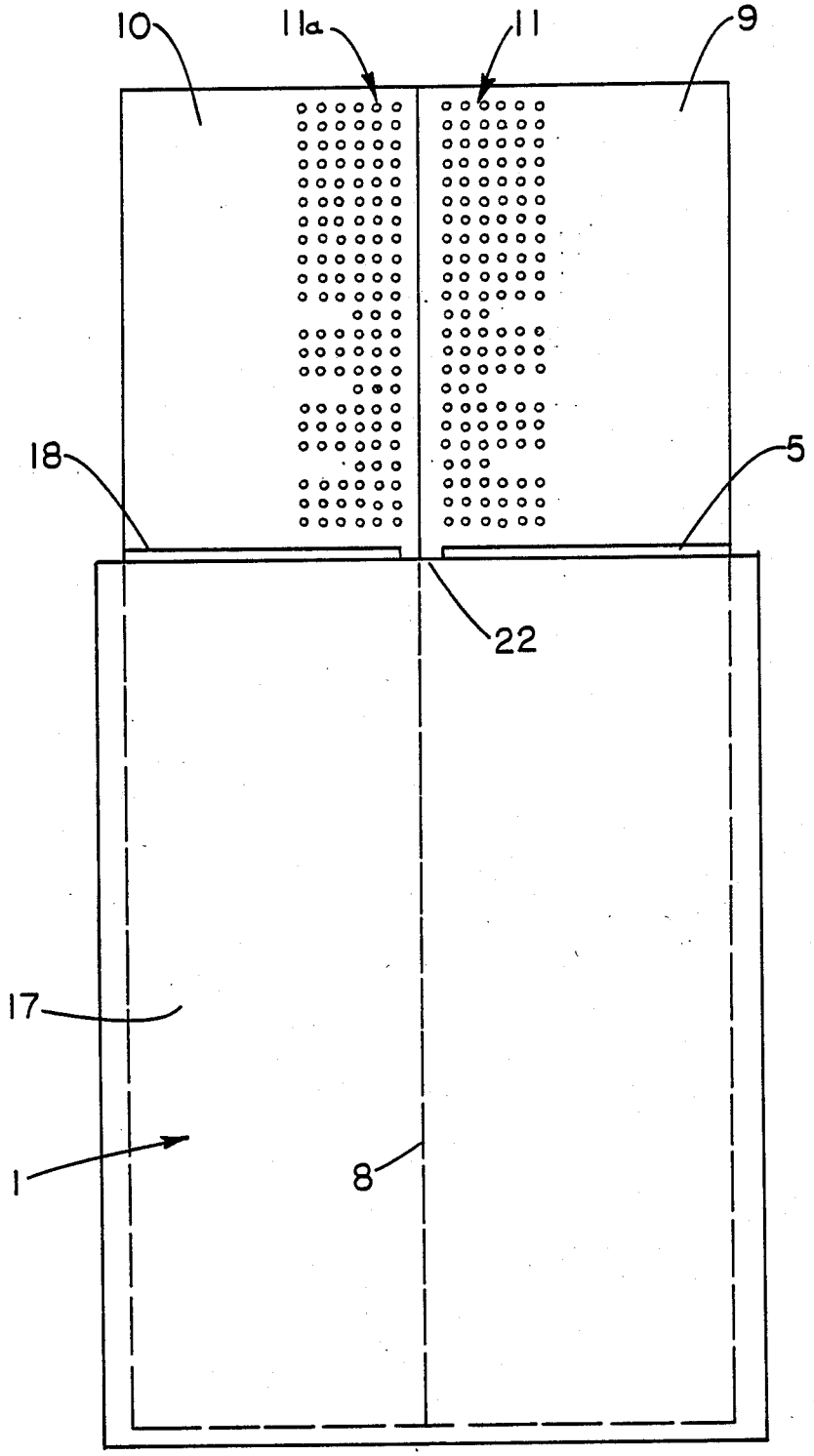
FIG. 6 shows a top plan view of the ventilator embodiment shown in FIGS. 1–3 and 5, with a cap shingle placed over the ventilator in preparation for installing the resulting ventilator/shingle combination on a roof ridge.
Figure 7:
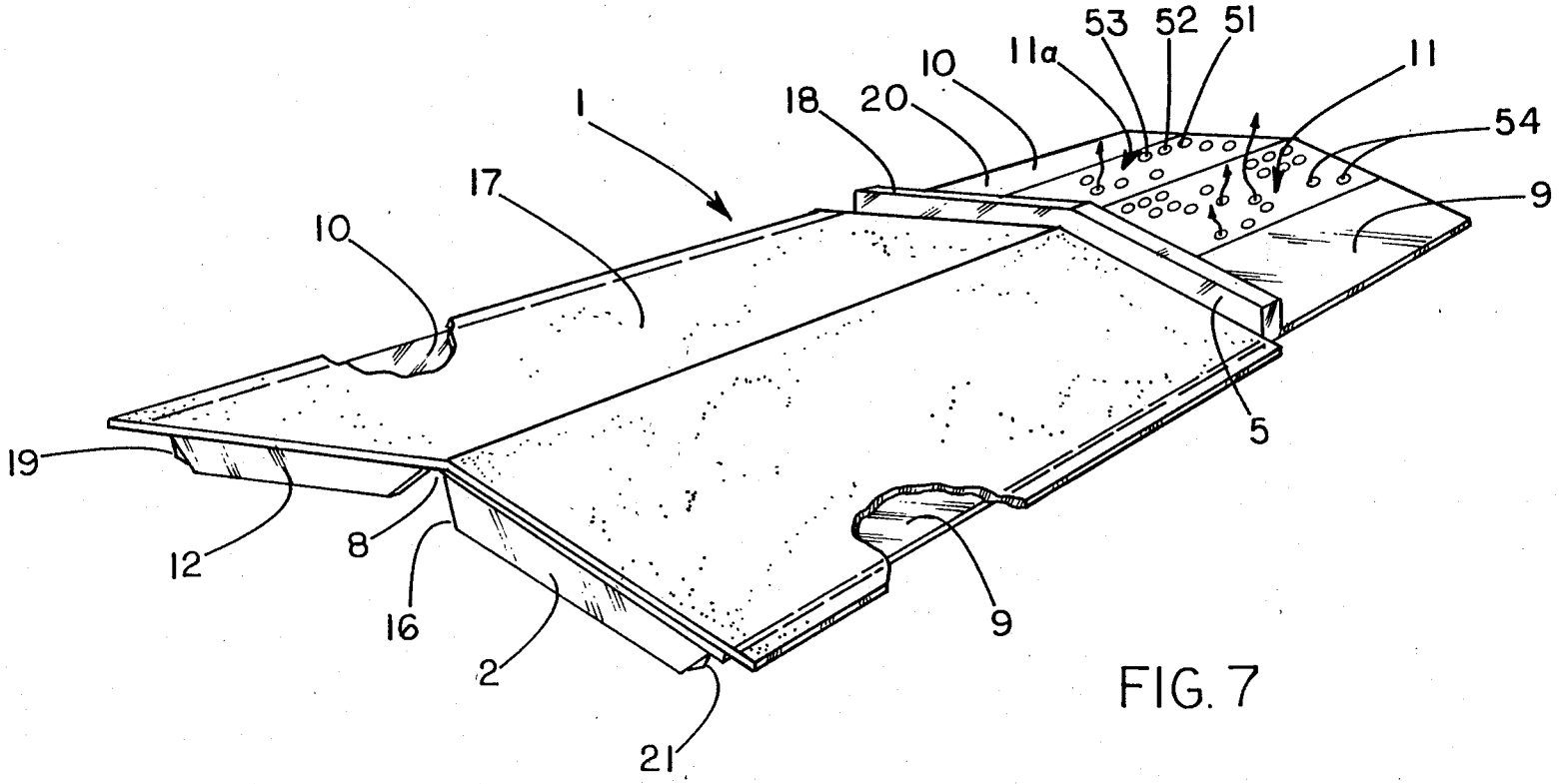
FIG. 7 shows one of the steps in the preferred method of attaching a ventilator/shingle combination to a roof ridge.

Panel 9 includes air passage panel 11 which extends from hinge 8 transversely across a portion of panel 9. Panel 10 includes air passage means 11*a* that extends from hinge 8 transversely across a portion of the surface of panel 10. As best seen in FIG. 3, air passage means 11 and 11*a* include a plurality of substantially round-shaped ports such as ports 51, 52 and 53 that have upwardly-projecting flanges such as flange 54 (see FIG. 7) around the circumference of each of these openings on upper surface 20 on panel 9 and on upper surface 20 of panel 10.

On the bottom surface of panel 10 is a plurality of downwardly-projecting support means, here ribs 12, 13, 14 and 15. Rib 12, which is positioned at or near one end 23 of ventilator 1 is of greatest height, measured from lower surface 24 of panel 10 to the bottom edge of support rib 12. Rib 13, which is also joined at right angles to lower surface 24 and projects downwardly therefrom, is of smaller height than rib 12. In turn, rib 14, which is also joined at substantially right angles to surface 24, projects downwardly a shorter distance than rib 13. Rib 15, joined at right angles to surface 24, also projects downwardly from surface 24, but is of smaller height than rib 14. In short, each successive rib behind rib 15 is of successively shorter height than the next preceding rib to facilitate placement of ventilator 1 over a roof ridge. Corresponding ribs 2, 3, 6 and 7 on panel 9 form a substantially similar series of ribs that are successively smaller in height.

Rib 2 is of substantially the same size and shape as rib 12, is in substantially the same plane as rib 12, and extends over substantially the same lateral distance on panel 9 as rib 12 does on panel 10. Similarly, rib 3 is substantially the same size and shape as rib 13, lies in substantially the same plane as rib 13, and is smaller in height than rib 2. Similarly, rib 6 is substantially the same size and shape as rib 14, lies in substantially the same plane as rib 14, extends substantially the same transverse distance across panel 9 as rib 14 does across panel 10, and is smaller in height than rib 6. Similarly, rib 7 is substantially the same size and shape as rib 15, and extends over substantially the same lateral distance across panel 9 as does rib 15 across panel 10. Ribs 7 and 15 are both smaller than the next preceding ribs 6 and 14. Between each of these corresponding pairs of ribs 2/12, 3/13, 6/14 and 7/15 is space 16, which is of sufficient size and shape to facilitate bending ventilator 1 along hinge 8 to facilitate placement on a roof ridge (see FIG. 1).

Figure 9:
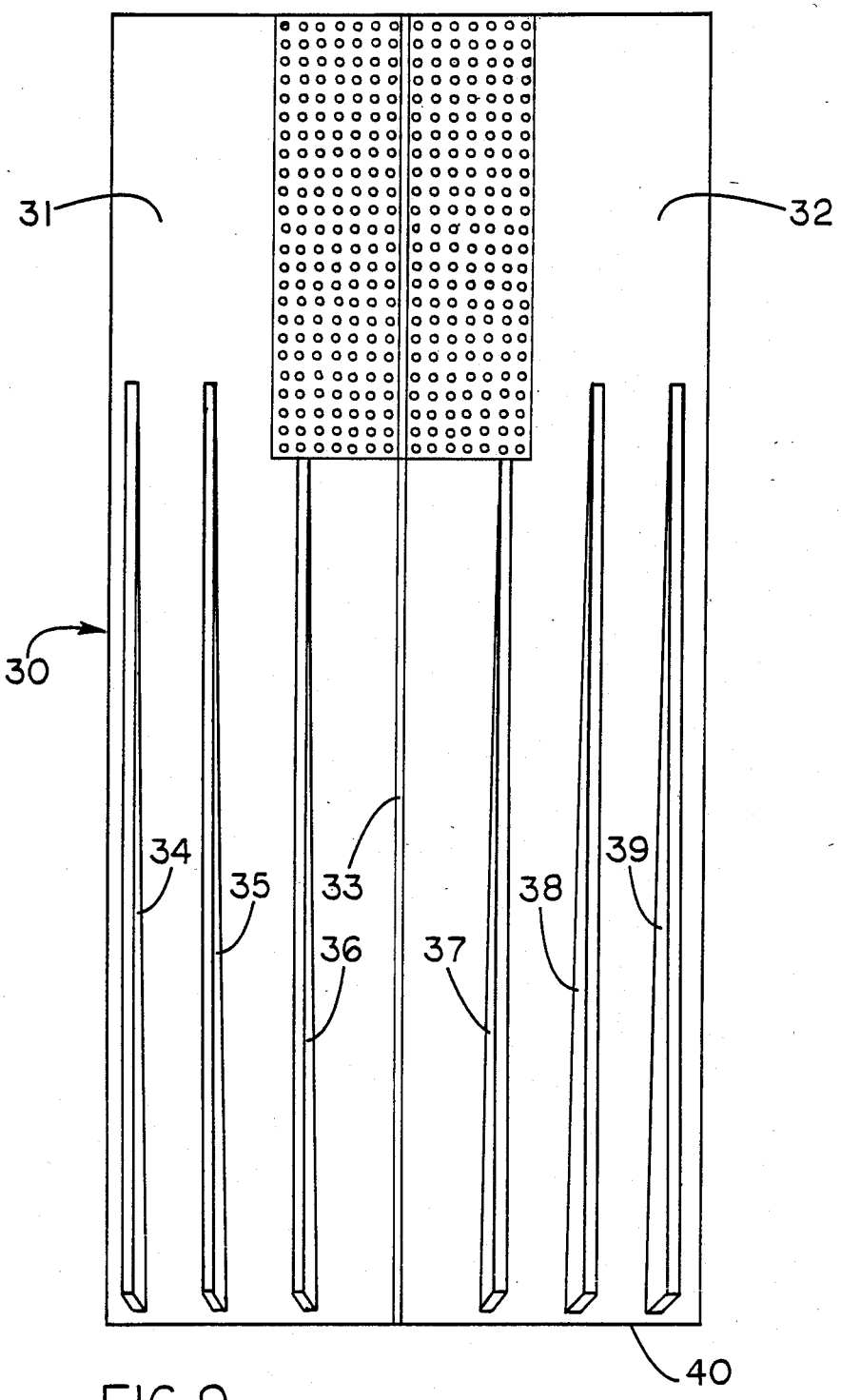
FIG. 9 shows a bottom plan view of a second ventilator embodiment.

FIG. 9 shows a second ventilator embodiment 30 in bottom plan view. Panels 31 and 32, joined along hinge means 33, are of substantially the same size and shape. Panel 31 includes a plurality of longitudinally-oriented support ribs 34, 35 and 36; panel 32, a plurality of such ribs 37, 38 and 39. These ribs are joined to panels 31 and 32 at substantially right angle,, and are formed integrally with one-piece ventilator 30 from a thermoplastic such as polypropylene. Each of these ribs 34, 35, 36, 37, 38 and 39 is substantially parallel to hinge 33. Each is of greatest height near end 40, and is of of gradually decreasing height over its entire length.

Figure 10:
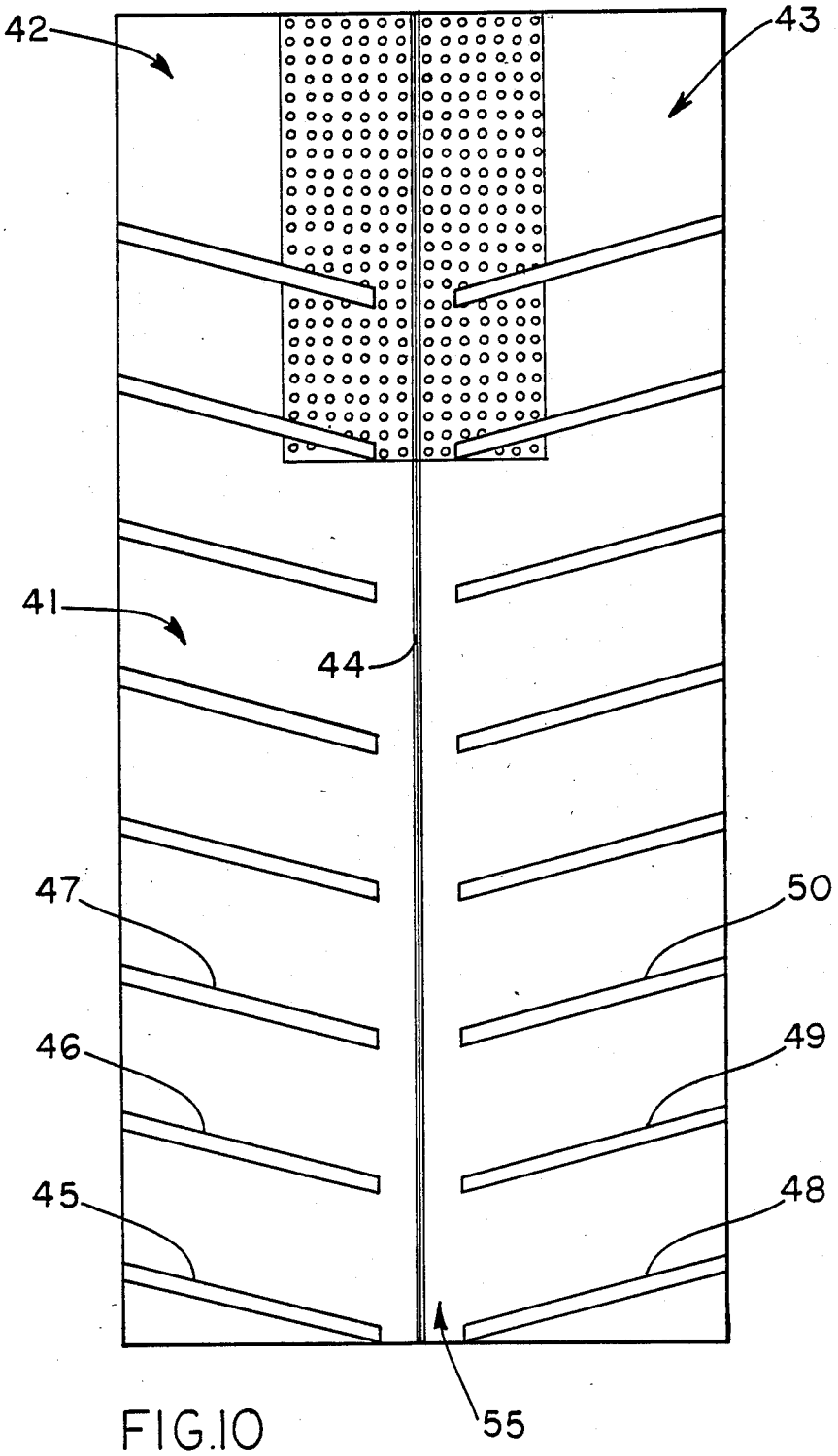
FIG. 10 shows a bottom plan view of a third ventilator embodiment.

FIG. 10 shows a third ventilator embodiment 41, including two integrally-formed panels 42 and 43 and horizontally-oriented hinge means 44. Each of panels 42 and 43 includes a plurality of support ribs, such as ribs 45, 46 and 47 on panel 42 and ribs 48, 49 and 50 on panel 43. Each of these ribs is joined to panels 42 and 43 at substantially right angles, and extends substantially completely across these panels at oblique angles to the axis of hinge means 44. As with the first ventilator embodiment 1, this embodiment 41 includes gap 55 to facilitate bending along hinge 44, and placement of ventilator 41 over a roof ridge.

FIGS. 2, and 4–8 illustrate a preferred method of installing ventilator 1 on a roof ridge in combination with cap shingle 17.

Conventional cap shingle 17 is placed over the upper surface of panels 9 and 10 (see FIG. 6), and the resulting ventilator/shingle combination is bent along hinge line 8 (see FIG. 7) to prepare the combination ventilator/-shingle for placement on a roof ridge.

Figure 8:
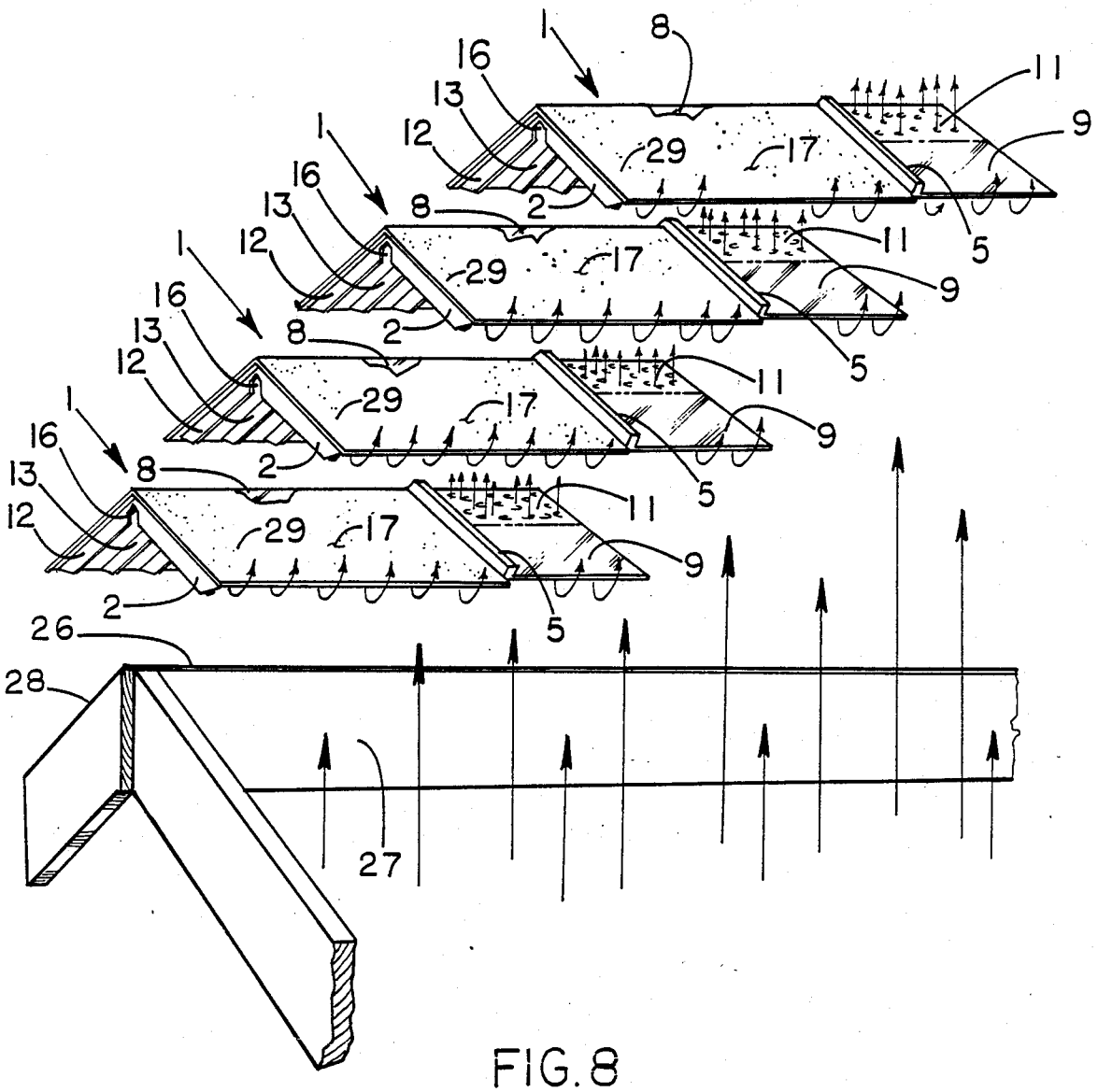
FIG. 8 shows a preferred method for attaching to a roof ridge a plurality of the preferred ventilator embodiment shown in FIGS. 1–3, as part of ventilator/cap shingle combinations, in accordance with the preferred embodiments of the installation methods of this invention.

As FIG. 8 shows, the combination of ventilator 1 and shingle 17 are placed over roof ridge 26 and against roof surfaces 27 and 28. The rear of cap shingle 17 abuts upwardly-projecting flanges 5 and 18, thus leaving the air passage panels 11 and 12 uncovered.

The first of the ventilator/shingle combinations, (see FIG. 8), is placed with gap 16 centered over roof ridge vent 26. Panel 9, with shingle 17 thereover, lies on pitched roof surface 27, and panel 10, with cap shingle 17 thereover, lies on pitched roof surface 28. A nail or other fastener is driven through shingle 17 and panel 9 at point 29, and another nail is driven through shingle surface 17 and panel 10 into pitched roof surface 28.

A second ventilator/shingle combination is then placed over the first shingle/ventilator combination. Upwardly-projecting flange 5 on the upper surface of the first ventilator/shingle combination engages one of the downwardly-projecting ribs on the lower surface of the ventilator in the second ventilator/shingle combination, and panels 9 and 10 in the second combination overlie panels 9 and 10 in the first ventilator/shingle combination. Third, fourth and further ventilator/shingle combinations are placed over, and behind the second and third ventilator combinations, respectively, with upwardly projecting flanges 5 and 18 on the upper surface of each of the ventilators engaging one of the downwardly-projecting ribs on the overlapping ventilator. When so engaged, upwardly-projecting and downwardly-projecting ribs form a barrier against inflow of water, other liquids and debris between overlapping ventilator/shingle combinations.

Each of the ventilator/shingle combinations is fastened to the roof by passing nails through each panel of the ventilator/shingle combination near the front of the ventilator/shingle combination.

What is claimed is:

1. A roof ridge ventilator comprising two panels joined by bendable hinge means, each of said panels having an upper surface and a lower surface, each of said lower surfaces including a plurality of spaced-apart, downwardly-projecting support means joined to said lower surfaces at substantially right angles, and extending transversely across the widths of said lower surfaces, said support means on each panel having differing heights, with the first support means of greatest height being near one end of said bottom surfaces, and with each successive support means behind said first support means having successively smaller height than the preceding support means; each of said lower surfaces having substantially the same number of support rib means with substantially the same sizes and spacing to permit bending of said ventilator over, and placement of said ventilator on a roof ridge; each of said panel means including, near the end opposite said one end, air passage means having a size and shape sufficiently small to permit overlapping said air passage means with a portion of the bottom surface of another of said ventilators.

2. The ventilator of claim 1 wherein said air passage means extends across said bendable hinge means and lies, in part, on each of said two panels.

3. The ventilator of claim 1 wherein each of said support means on the first of said lower surfaces is spaced sufficiently far from corresponding support means on the second of said lower surfaces to facilitate bending said ventilator through said hinge means when said ventilator is placed over a roof ridge.

4. The ventilator of claim 1 further comprising, on said upper surface, upwardly-projecting flange means on at least one of said panel means, said flange means being positioned in front of said air passage means, said flange means extending transversely across said upper surface to engage one of said downwardly-projecting support means.

5. The ventilator of claim 1 wherein said upper surfaces are adapted to receive a cap shingle as a cover for a substantial portion of said upper surfaces.

6. The ventilator of claim 1 wherein said ventilator is a unitary member, said two panels are substantially the same in length and width, and said bendable hinge means is horizontally oriented.

7. A method for attaching to a roof ridge a roof ventilator comprising two panels joined by bendable hinge means, each of said panels having an upper surface and a lower surface, each of said lower surfaces including a plurality of spaced-apart, downwardly-projecting support means joined to said lower surfaces at substantially right angles, and extending transversely across the widths of said lower surfaces, said support means on each panel having differing heights, with the first support means of greatest height being near one end of said bottom surfaces, and with each successive support means behind said first support means having successively smaller height than the preceding support means; each of said lower surfaces having substantially the same number of support rib means with substantially the same sizes and spacing to permit bending of said ventilator over, and placement of said ventilator on a roof ridge; each of said panel means including, near the end opposite said one end, air passage means having a size and shape sufficiently small to permit overlapping said air passage means with a portion of the bottom surface of another of said ventilators; placing a cap shingle over the upper surface of said ventilator with said air passage means substantially uncovered by said cap shingle to form a first ventilator/shingle combination; bending said first ventilator/shingle combination along said hinge means; placing said first ventilator/shingle combination over said roof ridge with said downwardly-projecting support means over said roof ridge; placing a second ventilator/shingle combination over said first ventilator/shingle combination over said roof ridge with said second ventilator/shingle combination overlapping at least said air passage means in said first ventilator/shingle combination; and attaching each of said first and said second ventilator/shingle combinations to said roof ridge.

8. The method of claim 7 wherein said attaching is effected by driving fasteners through each of said ventilator/shingle combinations near said one end of each of said ventilators.

9. A roof ridge ventilator comprising two panels joined by bendable hinge means, each of said panels having an upper surface and a lower surface, each of said lower surfaces including a plurality of spaced-apart, downwardly-projecting support means joined to said lower surfaces at substantially right angles, and extending obliquely across the widths of said lower surfaces, said support means on each panel having different heights, with the first support means of greatest height being near one end of said bottom surfaces, and with each successive support means behind said first support means having successively smaller height than the preceding support means; each of said panel means including, near the end opposite said one end, air passage means having a size and shape sufficiently small to permit overlapping said air passage means with a portion of a bottom surface of another of said ventilators.

10. The ventilator of claim 9 wherein said air passage means extends across said bendable hinge means and lies, in part, on each of said two panels.

11. The ventilator of claim 9 wherein each of said support means on the first of said lower surfaces is spaced sufficiently far from corresponding support means on the second of said lower surfaces to facilitate bending said ventilator through said hinge means when said ventilator is placed over a roof ridge.

12. The ventilator of claim 9 further comprising, on said upper surface, upwardly-projecting flange means on at least one of said panel means, said flange means being positioned in front of said air passage means, said flange means extending transversely across said upper surface to engage one of said downwardly-projecting support means.

13. The ventilator of claim 9 wherein said upper surfaces are adapted to receive a cap shingle as a cover for a substantial portion of said upper surfaces.

14. The ventilator of claim 9 wherein said ventilator is a unitary member, said two panels are substantially the same in length and width, and said bendable hinge means is horizontally oriented.

15. A roof ridge ventilator comprising two panels joined by bendable hinge means, each of said panels having an upper surface and a lower surface, each of said lower surfaces including a plurality of spaced-apart, downwardly-projecting support means joined to said lower surfaces at substantially right angles, and extending longitudinally along the lengths of said lower surfaces, each of said support means being of greatest height near one end of said bottom surface, and gradually diminishing in height along the length of each of said support means; each of said panel means including, near the end opposite said one end, air passage means having a size and shape sufficiently small to permit overlapping said air passage means with a portion of the bottom surface of another of said ventilators.

16. The ventilator of claim 15 wherein said air passage means extends across said bendable hinge means and lies, in part, on each of said two panels.

17. The ventilator of claim 15 wherein each of said support means on the first of said lower surfaces is spaced sufficiently far from corresponding support means on the second of said lower surfaces to facilitate bending said ventilator through said hinge means when said ventilator is placed over a roof ridge.

18. The ventilator of claim 15 further comprising, on said upper surface, upwardly-projecting flange means on at least one of said panel means, said flange means being positioned in front of said air passage means, said flange means extending transversely across said upper surface to engage one of said downwardly-projecting support means.

19. The ventilator of claim 15 wherein said upper surfaces are adapted to receive a cap shingle as a cover for a substantial portion of said upper surfaces.

20. The ventilator of claim 15 wherein said ventilator is a unitary member, said two panels are substantially the same in length and width, and said bendable hinge means is horizontally oriented.

* * * * *

UNITED STATES PATENT AND TRADEMARK OFFICE

CERTIFICATE OF CORRECTION

PATENT NO. : 4,907,499

DATED : March 13, 1990

INVENTOR(S) : James A. F. Gatacre

It is certified that error appears in the above-identified patent and that said Letters Patent is hereby corrected as shown below: Title page, item [76]:

"Inventor: "Gatacre A. F. James", should read: --Inventor: James A. F. Gatacre--

Signed and Sealed this

Ninth Day of July, 1991

*Attest:*

*Attesting Officer*

HARRY F. MANBECK, JR.

*Commissioner of Patents and Trademarks*